US005992432A

United States Patent [19]

Hörger et al.

[11] Patent Number: 5,992,432

[45] Date of Patent: Nov. 30, 1999

[54] HYDRODYNAMIC NOZZLE FOR CLEANING PIPES AND CHANNELS

[76] Inventors: Kurt Hörger, Kleiststrasse 13, 09130 Chemnitz; Hans Lutze, Am Karbel 25, 09116 Chemnitz, both of Germany

[21] Appl. No.: 08/917,579

[22] Filed: Jun. 30, 1997

Related U.S. Application Data

[63] Continuation-in-part of application No. PCT/DE96/00825, May 4, 1996.

[30] Foreign Application Priority Data

May 11, 1995 [DE] Germany ..... 195 16 780

[51] Int. Cl.[6] ..... B08B 3/00

[52] U.S. Cl. ..... 134/167 C; 134/168 C; 134/169 C

[58] Field of Search ..... 134/166 R, 168 C, 134/167 C, 169 C; 15/104.05, 104.061

[56] References Cited

U.S. PATENT DOCUMENTS

| | | | |
|---|---|---|---|
| 1,587,194 | 6/1926 | Sladden . | |
| 1,628,070 | 5/1927 | Sladden . | |
| 3,656,694 | 4/1972 | Kirschke | 239/533 |
| 3,702,685 | 11/1972 | Kirschke . | |
| 3,807,714 | 4/1974 | Hollyer . | |
| 3,814,330 | 6/1974 | Masters | 239/558 |
| 4,312,679 | 1/1982 | Klein, Sr. | 134/8 |
| 4,715,538 | 12/1987 | Lingau | 239/248 |
| 4,799,554 | 1/1989 | Clapp et al. | 166/312 |
| 4,891,115 | 1/1990 | Shishkin et al. | 204/212 |
| 4,995,201 | 2/1991 | Von Borcke et al. | 51/411 |
| 5,383,975 | 1/1995 | Faxon | 134/22.11 |
| 5,535,473 | 7/1996 | Maniar | 15/104.33 |
| 5,551,458 | 9/1996 | Faxon | 134/22.12 |
| 5,580,393 | 12/1996 | Lawther | 134/8 |

FOREIGN PATENT DOCUMENTS

| | | |
|---|---|---|
| 805209 | 3/1951 | Germany . |
| 9214268 | 3/1993 | Germany . |
| 8505295 | 12/1985 | WIPO . |

*Primary Examiner*—Frankie L. Stinson
*Assistant Examiner*—Paul J. Lee
*Attorney, Agent, or Firm*—Horst M. Kasper

[57] ABSTRACT

A hydrodynamic nozzle for the cleaning of pipes and channels exhibits a distribution chamber (7), joining to the pressurized water-entrance opening (4), wherein the pressurized water-discharge opening (5*a*, 5*b*) join into the distribution chamber (7) through channels (6*a* and 6*b*). The distribution chamber (7) exhibits a cone-shaped water subdivider (8), to which a defined radius (r1) follows, wherein the curvature of the radius (r1) is opposite to that of the pressurized water-entrance opening (4). The channels (6*a* and 6*b*) are merging tangentially at this radius (r1). Furthermore, the nozzle body (1) can be subdivided into an upper part (2) and a lower part (3), and can exhibit a separate form element (14), which forms the water subdivider (8) and the radius (r1), in the lower part (3). The degree of effectiveness is substantially increased with the nozzle according to the invention and thus the axial pressure of the exiting beam of liquid and the cleaning effect is substantially increased.

20 Claims, 7 Drawing Sheets

HYDRODYNAMIC NOZZLE FOR CLEANING PIPES AND CHANNELS

CROSS-REFERENCE TO RELATED APPLICATIONS

This application is a continuation-in-part application of another international application filed under the Patent Cooperation Treaty on May 4, 1996, bearing Application No. PCT/DE96/00825, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The invention relates to a hydrodynamic nozzle for the cleaning of pipes and channels, formed of a nozzle base body having a connector for a water hose as a pressurized water-entrance opening, and having pressurized water-discharge openings on the side of the pressurized water-entrance opening disposed on the same or different part reference circles, wherein the pressurized water-discharge openings are connected through channels to the pressurized water-entrance openings, wherein the pressurized water-discharge openings and the channels are disposed inclined at a defined angle relative to the axis of the nozzle body.

2. Brief Description of the Background of the Invention Including Prior Art

Numerous channel-cleaning nozzles are known, which exhibit a water connector providing a pressurized water-entry connector opening and recoil openings, directed rearwardly and connected to the pressurized water-entry connector. The nozzle is subjected to an advance motion in the pipe or channel based on the recoil force of the water. Such a nozzle body made of full solid material is taught in the German petit patent document DE G 92 14 268.8. The connection between the water connector and the water discharge ports (recoil openings) is performed in this case through a first borehole, running from the water connector at an inclined angle toward the outside into the nozzle body, and a second borehole, leading from the water discharge port at an inclined angle toward the inside, wherein the second borehole reaches up to the first borehole and is connected with the first borehole. The apex regions of the boreholes are rounded in this construction in order to avoid turbulences. The water connector exhibits a conical borehole base, wherein the cone is open in the direction of the hose connector. The first boreholes are entered into the borehole base. The decisive disadvantage of this construction comprises that the water impacts onto the base of the borehole of the water connector, whereby turbulences and thus power losses and a decrease in efficiency occurs. Furthermore, it is disadvantageous that the two connection boreholes meet at an acute angle.

An already somewhat improved nozzle with respect to flow technology is taught in the printed patent document WO 85/05295. Here, the connection channels between the pressurized water-entrance opening and the recoil opening exhibit a relatively large radius. In FIG. 2 of the printed patent document WO 85/05295 such a nozzle is shown which exhibits in the center in the region of the hose connector a conical-shaped water subdivider, where the radius joins at the conical-shaped water subdivider. The hollow space in the nozzle expands at a relatively sharp edge from the hose connector such that a ring-shaped impact face is formed in the direction of the recoil openings. The discharge openings lead from the impact face in the hollow space outwardly over a discharge beam angle or range of deflection. Nozzles are inserted into the discharge openings, wherein the nozzles exhibit a conical expansion of the inner diameter in a direction toward the hollow space. Based on the impact of the liquid stream onto the impact face, there is generated an unsteady cross-section decrease according to the hydrodynamics, which decreases the degree of efficiency already to about 70%. The pressure resistance and the form drag of the impact plate are present in addition, which impedances result in a further substantial decrease of the degree of effectiveness, wherein the largest drag coefficient of a circular plate is to be employed in the present case.

Based on this unfavorable flow-technical construction, the axial pressure of the exiting water beam is weakened and thus the cleaning effect is decreased.

SUMMARY OF THE INVENTION

1. Purposes of the Invention

It is an object of the present invention to develop a hydrodynamic nozzle for the cleaning of pipes and channels, which assures a highest possible degree of effectiveness and thus an optimum cleaning power, and which exhibits a simple construction.

These and other objects and advantages of the present invention will become evident from the description which follows.

2. Brief Description of the Invention

The present invention provides for a hydrodynamic nozzle for the cleaning of pipes and channels and formed as a nozzle base body having an axis. A connector for a water hose is constructed as a pressurized water-entrance opening. A first set of pressurized water-discharge openings is disposed on the side of nozzle base body carrying the pressurized water-entrance opening. The pressurized water-discharge openings are aligned on a first part reference circle. The pressurized water-discharge openings are connected through channels of the first set of channels to the pressurized water-entrance opening. The pressurized water-discharge openings of the first set of pressurized water-discharge openings and the channels of the first set of channels are disposed inclined at a defined angle $\alpha 1$ relative to the axis of the nozzle base body. A distribution chamber is disposed inside of the nozzle base body and connected to the pressurized water-entrance opening and connected to the channels of the first set of channels for providing a connection between the pressurized water-entrance opening and the pressurized water-discharge openings. A water subdivider exhibits a rotary axis and a cone tip and an end disposed opposite to the cone tip and protruding from the base of the distribution chamber. The water subdivider is disposed on an opposite side of the distribution chamber relative to the pressurized water-entrance opening. The water subdivider is disposed centered relative to the axis of the nozzle base body. The cone tip of the water subdivider is directed in a direction of the pressurized water-entrance opening. An inner face of substantially a first torus segment has a first radius r1 of a generating circle of the first torus. Said inner face of substantially the first torus merges to the end of the water subdivider. The inner face of the first torus segment is disposed substantially opposite to the pressurized water-entrance opening in the distribution chamber. The inner face of the first torus segment forms a base of the distribution chamber. Each channel of the first set of channels is inclined at the angle $\alpha 1$ and merges such into the distribution chamber that an outer line of an outer diameter of the respective channel of the first set of channels merges with the first torus segment.

A second set of pressurized water-discharge openings can be disposed on the side of the nozzle base body carrying the pressurized water-entrance opening. The pressurized water-discharge openings of the second set of pressurized water-discharge openings can be aligned on a second part reference circle. The pressurized water-discharge openings of the second set of pressurized water-discharge openings can be connected through the channels of a second set of channels to the pressurized water-entrance opening. The pressurized water-discharge openings of the second set of pressurized water-discharge openings and the channels of the second set of channels can be disposed inclined at a second defined angle $\alpha 2$ relative to the axis of the nozzle base body. Each channel of the second set of channels can be inclined at the angle $\alpha 2$ and can merge such into the distribution chamber that an outer line of an outer diameter of the respective channel of the second set of channels merges with the first torus segment. The water subdivider can exhibit a conical shape and can have a defined cone angle gamma.

A second torus segment can surround the pressurized water-entrance opening in the direction of the distribution chamber. A generating circle of the second torus segment can be associated with a second radius r2. The second radius r2 can exhibit the same direction of curvature as the first radius r1. The second torus segment can be connected through a further, third torus segment. A generating circle of the third torus segment can be associated with a radius r3. The third torus segment can show an opposite direction of curvature relative to the direction of curvature of the first torus segment.

A diameter of each channel can expand in a funnel-shape at an end of the channel, which end joins into the distribution chamber. An opening angle $\beta 1$ of the funnel-shaped expansion can amount to 90°.

The nozzle base body can be subdivided into an upper part and a lower part.

A subdivision plane can be disposed in a region of the distribution chamber passing through center points of the generating circles of the first torus segment and aligned perpendicular to the axis of the nozzle base body. The pressurized water-entrance opening and the pressurized water-discharge openings as well as a face of the second torus segment and a face of the third torus segment can be disposed in the upper part. The water subdivider and the inner face of the first torus segment can be disposed in the lower part.

A subdivision plane can be disposed in a region of the distribution chamber at a level of the center points of the generating circles of the first torus segment and parallel to the axis M of the nozzle base body.

The water subdivider can be attached to the nozzle base body.

The water subdivider can be attached to the lower part of the nozzle base body.

A centered axial passage can be furnished by a through borehole disposed extending from the distribution chamber to an end of the nozzle base body, which end of the nozzle body is disposed opposite to the pressurized water-entrance opening.

The through borehole can expand like a funnel at its end in the water subdivider opened in a direction toward the distribution chamber. An opening angle $\beta 2$ of the funnel-shaped expansion of the through borehole can amount to from about 20 to 40°.

Faces of the pressurized water-entrance opening, of the distribution chamber, and of the channels, along which the flow medium flows, can be machined such that a drag coefficient is minimized.

The water subdivider and a base of the distribution chamber, which base is formed by the first torus segment, can be furnished with a drag-coefficient-lowering coating B.

A unit of the water subdivider and of the first torus segment can be formed as a separate form element and can be disengageably disposed in a corresponding recess in a lower part of the nozzle base body. The form element can be made of a wear-resistant material.

The channel-cleaning nozzle comprises here a nozzle base body with a connector for a water hose as a pressurized water-entrance opening. The pressurized water-discharge openings are disposed on the same or different part references circles on the side of the pressurized water-entrance opening, and the pressurized water-discharge openings are connected through channels with the pressurized water-entrance opening. The channels are inclined at a defined angle relative to the axis of the nozzle body.

According to the present invention, a distribution hollow space follows next to the pressurized water-entrance opening, wherein channels, connected to the pressurized water-discharge openings, join into the distribution hollow space. On the base of the distribution hollow space, which is disposed opposite to the pressurized water-entrance opening, a conical-shaped water subdivider with a defined cone angle is disposed centered relative to the axis of the nozzle body, wherein the cone tip of the water subdivider is directed in the direction toward the pressurized water-entrance opening.

A defined, substantially semi-circular radius follows to the cone base of the water subdivider, wherein the curvature of the semi-circular radius is directed opposite to the pressurized water-entrance opening. Each channel joins into the distribution hollow space such that the outermost line of the outer diameter of the channel rests tangentially at the radius or, respectively, continues into the radius.

In addition, the pressurized water-entrance opening exhibits in the direction of the distribution hollow space circumferentially a diameter-increasing radius, which exhibits the same direction of curvature as the radius which follows to the water subdivider.

These two radii are connected to each other for the avoidance of vortex formations and turbulences through a further radius with an opposite direction of curvature. In addition, the diameter of each channel expands like a funnel at that end, which joins into the distribution hollow space. The opening angle of the funnel amounts preferably from 45 to 90 degrees.

For assuring an economic production, the nozzle body is formed in a subdivided construction. The subdivision plane is disposed in the region of the distribution hollow space in the center of the radius and perpendicular to the axis of the nozzle body in case of nozzles having relatively large dimensions.

The subdivision plane can be disposed in the region of the distribution hollow space in the center of the radius and parallel to the axis of the nozzle body in case of nozzles having smaller dimensions. In case of so-called pull nozzles, it is conventional to dispose a centered axial through borehole from the distribution hollow space up to the end of the nozzle body, which end is disposed opposite to the pressurized water-discharge openings. This through borehole exhibits according to the invention a funnel-shaped diameter expansion at the end of the through borehole in the water subdivider in the direction toward the distribution hollow space.

The opening angle of the funnel of the through borehole amounts preferably from 20 to 90 degrees.

According to the invention there is provided the possibility to produce separately the water subdivider or a unit of a water subdivider and the thereto following radius and to insert this water subdivider or unit into the nozzle body or, respectively, the lower part of the nozzle body.

A funnel-shaped feed of the flow medium from the pressurized water-entrance opening to the channels is achieved with this hydrodynamic nozzle according to the invention, wherein the channels are resting tangentially on the radius, which radius is adjoining to the funnel, and based on the gradual radial-shaped diameter expansion of the pressurized water-entrance opening. In addition, the flow-technical behavior is improved based on the funnel-shaped diameter expansion of the channels in the direction of the distribution hollow space.

Impact losses and turbulent flows are reduced nearly to zero based on the first-time complete elimination of unsteady cross-sectional changes as well as form drags based on the novel and elegant interior construction of the nozzle.

Based on the subdivided structure of the nozzle, it is easily possible to machine the interior spaces for a decreasing of the drag coefficient and for an increasing of the wear resistance, for example by coating. Already the coating of the water subdivider and the thereto adjoining radius in the nozzle lower part effects a substantial decrease of the drag coefficient. The degree of effectiveness of the hydrodynamic nozzle according to the invention in comparison to conventional channel-cleaning nozzles of the same constructions is substantially increased with these relatively small constructive changes.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
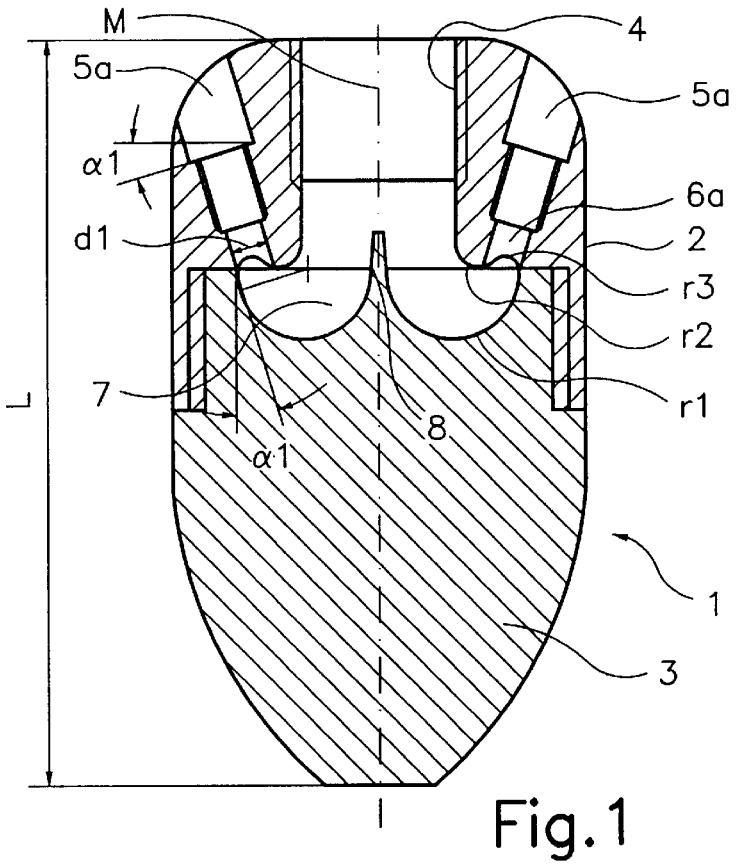
FIG. 1 is a sectional view of a nozzle.

According to the present invention, there is provided for a hydrodynamic nozzle for the cleaning of pipes and channels, formed of a nozzle base body having a connector for a water hose as a pressurized water-entrance opening, and having pressurized water-discharge openings on the side of the pressurized water-entrance opening disposed on the same or different part circles. The pressurized water-discharge openings are connected through channels to the pressurized water-entrance openings. The pressurized water-discharge openings and the channels are disposed inclined at a defined angle relative to the axis of the nozzle body. A distribution chamber 7 follows to the pressurized water-entrance opening 4, into which the channels 6*a* and 6*b*, connected to the pressurized water-discharge openings 5*a*, 5*b*, are joining. A conical-shaped water subdivider 8 with a defined cone angle gamma is disposed at the base of the distribution chamber 7, disposed oppositely to the pressurized water-entrance opening 4, and centered relative to the axis of the nozzle body 1. The cone tip 8 of the conical-shaped water subdivider 8 is directed in the direction of the pressurized water-entrance opening 4. A defined and substantially semi-circular first radius r1 follows to the cone base of the water subdivider 8, where the curvature of the radius r1 is directed substantially opposite to the pressurized water-entrance opening 4 and where the radius r1 forms the base of the distribution chamber 7. Each channel 6*a*, 6*b*, inclined at an angle $\alpha 1$, $\alpha 2$, joins such into the distribution chamber 7 that the outermost line of the outer diameter of the channel 6*a*, 6*b* aligns tangentially at the first radius r1 or, respectively, merges continuously into the first radius r1.

The pressurized water-entrance opening 4 can exhibit in the direction of the distribution chamber 7 and radially circumferentially a diameter-increasing second radius r2. The second radius r2 can exhibit the same direction of curvature as the first radius r1. The second radius r2 can be connected through a further third radius r3 with an opposite direction of curvature relative to the direction of curvature of the first radius r1. The diameter of each channel 6*a*, 6*b* can be expanded in a funnel-shape at the end of the channel 6*a*, 6*b*, which end joins into the distribution chamber 7. The nozzle body 1 can be subdivided into an upper part 2 and a lower part 3. The subdivision plane can be disposed in the region of the distribution chamber 7 in the center point of the first radius r1 and perpendicular to the axis of the nozzle body 1. The pressurized water-entrance opening 4 and the pressurized water-discharge openings 6*a* and 6*b* as well as the second radius r2 and the third radius r3 can be disposed in the upper part 2. The water subdivider 8 and the first radius r1 can be disposed in the lower part 3. The subdivision plane can be disposed in the region of the distribution chamber 7 in the center point of the first radius r1 and parallel to the axis M of the nozzle body 1.

The water subdivider 8 can be disengageably or fixedly placed into the nozzle body 1. The water subdivider 8 can be disengageably or fixedly placed into the lower part 3 of the nozzle body 1. A centered axial through borehole 12 can be disposed from the distribution chamber 7 up to the end of the nozzle body 1, which end of the nozzle body 1 is disposed opposite to the pressurized water-entrance opening 4. The through borehole 12 can expand like a funnel at its end in the water subdivider 8 in the direction toward the distribution chamber 7. The opening angle β2 of the funnel-shaped expansion 13 of the through borehole 12 can amount to 30°. The faces of the hollow spaces, at which the flow medium flows along, can be machined such that the drag coefficient is minimized. The water subdivider 8 and the base of the distribution chamber 7, which base is formed by the circumferential first radius r1, can be furnished with a drag-coefficient-lowering coating B. The unit of water subdivider 8 and first radius r1 can be formed as a separate form element 14 and is disengageably disposed in a corresponding recess in the lower part 3. The form element 14 can be made of a wear-resistant material.

Figure 2:
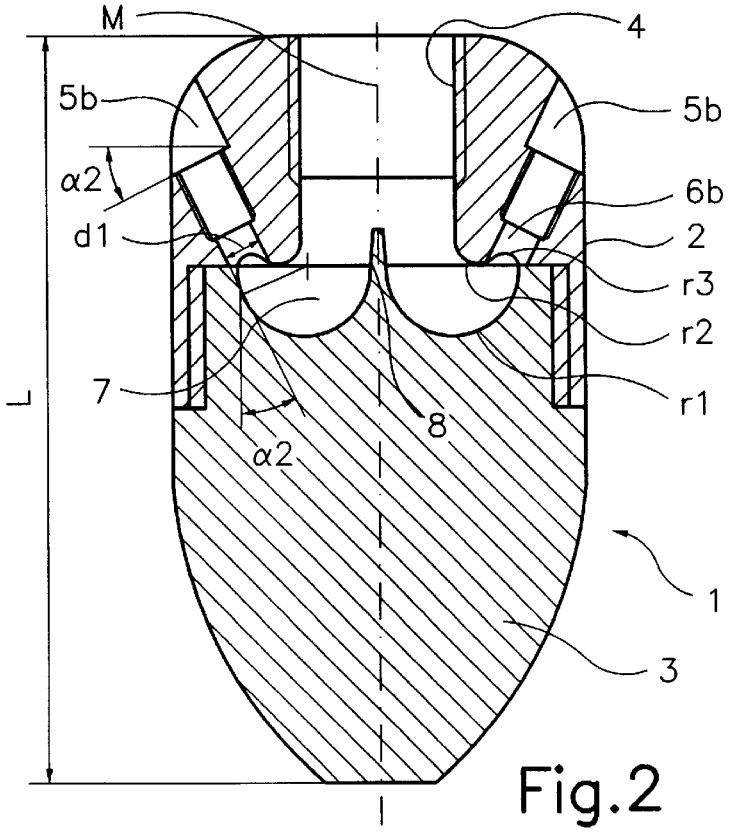
FIG. 2 is a sectional view of a nozzle turned by 45° relative to the position of FIG. 1.
Figure 3:
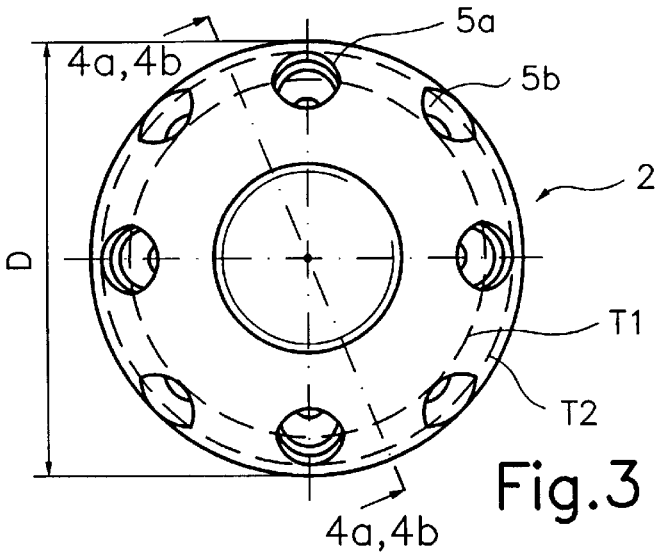
FIG. 3 is a top planar view onto the nozzle according to FIG. 1.

A hydrodynamic nozzle with overall eight discharge openings and a subdivided nozzle body 1 is shown in FIGS. 1, 2, and 3. The nozzle body 1 generally exhibits an elongated shape which has an overall form of an ellipse or a shell-case. A longitudinal axis of the nozzle body coincides substantially with the advance direction of the nozzle body 1. The length of the nozzle body is from about 1 to 3 times the diameter of the nozzle body and preferably from about 1.5 to 2 times the diameter of the nozzle 1 body. The nozzle body exhibits a substantially aerodynamic cylindrical form in the front when considering the advance direction of the nozzle 1 when put in motion. The aerodynamic curvature of the outer surface of the nozzle 1 extends over from about one third to two thirds of the length of the nozzle 1 measured from the front of the nozzle 1. The outer rear edge of the nozzle is formed curved and represents a sector of a torus. The radius of this torus can be from about one eighth to three eighths of the maximum diameter of the nozzle 1. A front center face of the nozzle can be flat and have a diameter of from about one eighth to three eighths of the diameter of the nozzle 1.

The nozzle body 1 comprises an upper or rear part 2 and a lower or front part 3. The bulk region of the lower part 3 has a length of from about 1.5 to 3 times the bulk length of the upper part 2 and preferably from about 1.8 to 2.5 times the bulk length of the upper part 2. The outer surface of the lower part 3 in the area adjoining the upper part is formed with an outer thread for attaching the upper part 2 to the lower part 3. The longitudinal length of the thread can be from about 0.2 to 0.5 times the length of the lower part 3 and is preferably 0.25 to 0.4 times the length of the lower part 3. The upper part 2 is formed with a lower outer cylindrical extension having an inner thread which matches the outer thread of the lower part 3. The longitudinal length of the outer cylindrical extension substantially coincides with the longitudinal length of the thread of the lower part 3 such that the outer surface of the cylindrical extension and the adjoining surface of the lower part 3 merge smoothly.

A pressurized water-entrance opening 8, formed as a hose connector, is disposed in the upper part 2. The pressurized water entrance opening 8 is furnished as a longitudinal borehole in the upper part 2 extending substantially through the full length of the upper part 2. The diameter of the pressurized water-entrance opening 8 can be from about 0.2 to 0.5 times the outer diameter of the nozzle and is preferably from about 0.3 to 0.4 times the outer diameter of the nozzle.

In each case overall pressurized water-discharge openings 5*a* and 5*b* are furnished at an angle of 45° and disposed alternatingly on differing reference circles T1 and T2. The angle of 45° is measured around the longitudinal axis and between the angular positions of centers of neighboring water-discharge openings. Preferably, an even number of water discharge openings is provided. The number of water discharge openings is preferably between 4 and 16, and more preferably between 6 and 12. The water discharge openings can be provided of two sets, wherein a first set of water-discharge openings 5*a* is disposed closer to the longitudinal axis, and wherein a second set of water-discharge openings 5*b* is disposed relatively more remote to the longitudinal axis and disposed such that the positions of the water-discharge openings of the first set 5*a* are alternating with the positions of the water-discharge openings of the second set 5*b*. In other words, the first set of water-discharge openings 5*a* is disposed at their upper end closer to the nozzle axis, and the second set of water-discharge openings 5*b* is disposed at their upper end more remote relative to the nozzle axis.

Here, the pressurized water-discharge openings 5*a,* which are disposed on the inner reference circle T1, exhibit a smaller beam position angle α as compared to the pressurized water-discharge openings 5*b* on the outer reference circle T2. In other words, the axial direction of the pressurized water-discharge openings 5*a,* which are disposed on the inner reference circle T1, exhibit a smaller beam deflection angle α relative to the longitudinal axis of the nozzle 1 as compared to the direction of the pressurized water-discharge openings 5*b* on the outer reference circle T2 having a larger beam deflection angle α relative to the longitudinal axis of the nozzle 1. The longitudinal section in the region of the pressurized water-discharge openings 5*a* with the beam position angle α1 is illustrated in FIG. 1, and the longitudinal section in the region of the pressurized water-discharge openings 5*b* with the beam position angle α2 is illustrated in FIG. 2. The position of the respective first channels, providing the pressurized water-discharge openings 5*a,* and the position of the respective second channels, providing the pressurized water-discharge openings 5*b* at the front end of the upper part, can be located with their centers on one single circle.

Figure 4A:
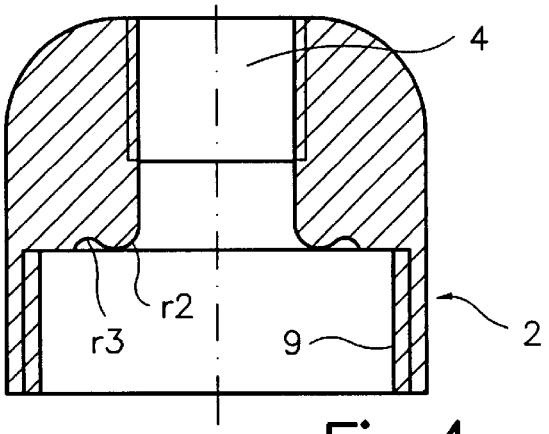
FIG. 4*a* is a schematic representation of an upper part of a subdivided nozzle.

A distribution hollow space 6 (FIG. 8) is formed at the connection to the pressurized-water-entrance opening 4 (FIG. 4*a*). The pressurized water-discharge openings 5*a* and 5*b* are connected through channels 6*a* and 6*b,* which join into the distribution hollow space 7, to the pressurized water-entrance opening 4. A conical-shaped water subdivider 8 is disposed at the base of the distribution hollow space 7, wherein the cone tip of the water subdivider 8 is directed in the direction toward the pressurized water-entrance opening 4. The conical axis of the water subdivider 8 substantially coincides with the longitudinal axis of the nozzle 1.

A radius r1 is furnished from the base of the water subdivider 8 up to the outermost point of the diameter d1 of the channels 6. The radius r1 is the radius of a generating circle for a torus or an anchor ring. The lower surface of the distribution hollow space 7 is defined by the inner surface of substantially a segment of the torus defined by a plane running perpendicular to the rotation axis of the torus. The rotation axis of the torus substantially coincides with the rotation axis of the nozzle 1. Preferably, the plane running perpendicular to the rotation axis of the torus is substantially a plane running also through the center of the circle generating the torus. The plane running perpendicular to the rotation axis of the torus preferably substantially coincides with the upper plane of the lower part 3. The subdivider 8 with its outer surface merges smoothly with the inner surface of the torus segment forming the lower surface of the distribution hollow space 7. The diameter of the generating circle of the torus is preferably from about 0.2 to 0.45 times the diameter of the nozzle 1 and is preferably from about 0.3 to 0.35 times the diameter of the nozzle. The distance of the center of the generating circle of the torus to the rotation axis of the torus is preferably from about 0.8 to 1 times the diameter of the pressurized water-entrance opening. The distance of the center of the generating circle of the torus to the rotation axis of the torus is preferably from about 0.25 to 0.45 times the diameter of the nozzle 1 and preferably from about 0.3 to 0.35 times the diameter of the nozzle 1.

The channels 6*a* and 6*b* are adjoining tangentially with the outermost point of their diameter d1 to this radius r1. In other words, the inner curved surface of the channels 6*a* and 6*b* at their radially outer region merges smoothly with the radially outer upper edge of the inner surface of the torus segment. The inclination angle relative to the axis M of the nozzle body 1 corresponds in the case of the channels 6*a*, connected to the discharge openings 5*a*, to an angle α1, and in the case of the channels 6*b*, connected to the discharge openings 5*b*, to an angle α2. The pressurized water-entrance opening 4 expands at its end in the direction of the distribution hollow space 7 into a radius r2, which radius r2 exhibits the same direction of curvature as the radius r1 at the base of the distribution hollow space 7. The radius r2 defines a radius of a generating circle of a second torus. While the inner face of the first torus segment defines the distribution hollow space 7, the outer face of the second torus defines the border of the distribution hollow space 7. The generating radius r2 of the second torus segment is from about 0.1 to 0.3 times the generating radius of the first torus segment, and preferably from about 0.2 to 0.25 times the generating radius of the first torus segment. The diameter of the channels 6*a* and 6*b* at the end adjoining the distribution hollow space 7 is preferably from about 0.4 to 0.6 times the radius of the circle generating the first torus.

The two radii r1 and r2 (FIG. 1) are connected to each other through a further radius r3, which radius r3 exhibits an opposite direction of curvature relative to the radii r1 and r2. The radius r3 defines a third torus segment defining the borders of the distribution hollow space 7. The third torus segment is disposed between the first torus segment and the second torus segment and smoothly merges into the first torus segment and into the second torus segment. The generating radius r3 of the third torus segment is from about 0.1 to 0.3 times the generating radius of the first torus segment, and preferably from about 0.2 to 0.25 times the generating radius of the first torus segment. The generating radius r3 of the third torus segment can be from about 0.2 to 1.5 times the radius r2 of the second torus segment.

In the following Table 1 there are shown exemplified embodiments for a number of five nozzle bodies 1 having a specific length L and a specific diameter D as well as a corresponding number of pressurized water-discharge openings 5*a*, 5*b*. The pressurized water-discharge openings 5*a*, 5*b* are disposed at the angle α1, α2, which indicate the radii r1, r2, and r3.

TABLE 1

| Length L (mm) | Diameter D (mm) | Number of Pressurized Water-Discharge Openings | Angles α1 and α2 (mm) | r1 Radius (mm) | r2 Radius (mm) | r3 Radius (mm) |
|---|---|---|---|---|---|---|
| 280 | 120 | 12 | 15° and 25° | 15.5 | 3.5 | 4.0 |
| 180 | 98 | 10 | 15° and 25° | 15.5 | 6.5 | 5.0 |
| 110 | 65 | 8 | 8.5° and 12° | 10 | 4.2 | 2.5 |
| 95 | 68 | 8 | 8° and 12° | 7.8 | 2.0 | 2.5 |
| 40 | 40 | 6 | only one angle α = 12° | 6.3 | 2 | 1.7 |

The top plan view of the nozzle according to FIGS. 1 and 2 is illustrated in FIG. 3. Since all channels are adjoining tangentially at the radius r1, however exhibit alternatingly different inclination directions, the axial centers of the pressurized water-discharge openings 5*a* and 5*b* are disposed on different reference circles T1 and T2 located on the upper face of the upper part 2. The larger the inclination angle α1, α2, and thereby the angle range of deflection is selected, the further outward is the position of the reference circles in the direction toward the outer diameter D of the nozzle body.

Figure 4B:
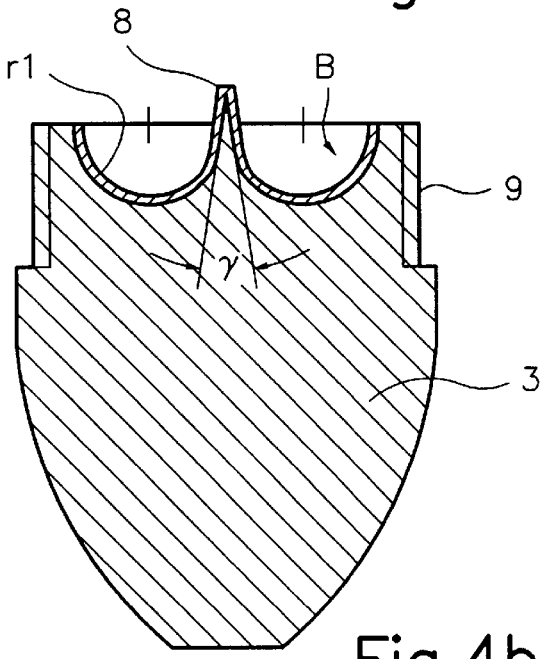
FIG. 4*b* is a schematic representation of a lower part of a subdivided nozzle.

The upper part 2 and the lower part 3 of the nozzle are shown in a separated state in FIGS. 4*a* and 4*b*. The section plane shown in FIGS. 4*a* and 4*b* was placed along the section line A—A in FIG. 3*a*. The division of the nozzle was hereby performed in the center point of the radius r1. The connection of the two nozzle halves 2 and 3 is performed in this embodiment through a thread 9. For mounting, the thread lower part is screwed into the nozzle upper part. The radii r1 and the water subdivider 8 are in this case disposed in the nozzle lower part 3, wherein the water subdivider protrudes into the nozzle upper part in the mounted state. The pressurized water-entrance opening 4 is disposed in the upper part 2, wherein the pressurized water-entrance opening 4 exhibits at its end directed to the nozzle interior space the outer face of the second toroidal segment having radius r2 and thereupon following the inner face of the third toroidal segment radius r3.

This subdivided nozzle construction is associated with substantial production technological advantages and can be simply produced. Advantageously in this context, initially the upper part 2 and the lower part 3 should be produced and, after their assembly, the forms defining channels 6*a* and 6*b* and the pressurized water-discharge openings 5*a* and 5*b* should be inserted, or wherein the channels 6*a* and 6*b* and the pressurized water-discharge openings 5*a* and 5*b* can be milled out. A further advantage of the subdivided nozzle construction comprises that the nozzle, in case of soiling, can be easily disassembled and cleaned. The water subdivider 8 and the radii r1 are in this example furnished with a coating B, which coating B decreases the drag coefficient.

FIG. 5 shows again a sectional view of the nozzle upper part 2 with milled-out channels 6*a* and pressurized water-discharge openings 5*a*. The pressurized water-entrance opening exhibits in addition a conical-shaped expansion 10 in front of the radius r2. The conical-shaped expansion can exhibit an expansion angle of from about 2 to 10 degrees and preferably from about 3 to 5 degrees, and the conical section begins substantially immediately adjoining an inner cylindrical wall to a connector screwed into the pressurized water-entrance opening 4.

Figure 5:
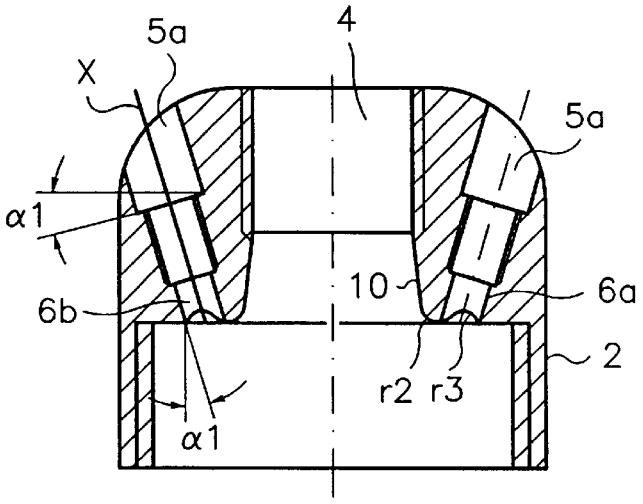
FIG. 5 is a view of the upper part of the subdivided nozzle with channels and pressurized water-discharge openings.
Figure 6:
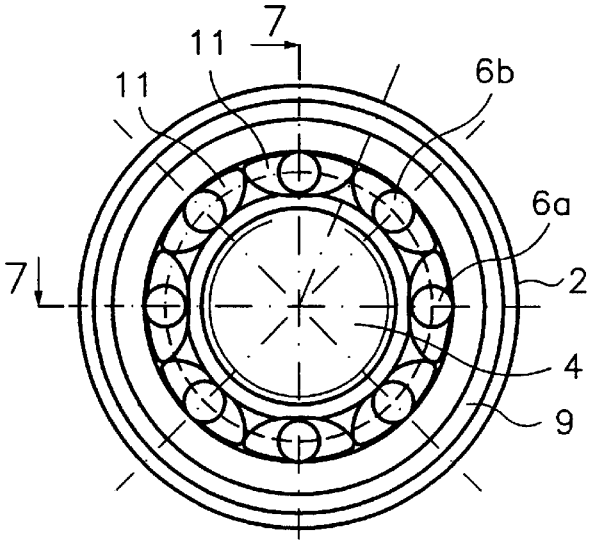
FIG. 6 is a view of the nozzle upper part from the direction of the distribution hollow space.

FIG. 6 shows a view according to FIG. 5 from the direction of the nozzle lower part 3. The channels 5*a* and 5*b* exhibit in an advantageous way at their lower end a funnel-shaped expansion 11, which lower end is disposed in each case opposite to the pressurized water-discharge openings 6*a* and 6*b* of the channels 5*a* and 5*b*.

Figure 7:
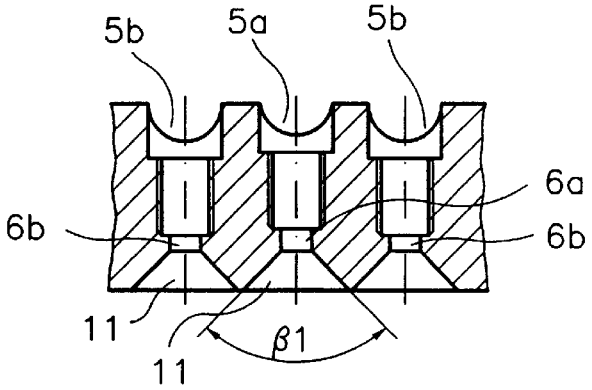
FIG. 7 is a sectional and developed view through three channels and discharge openings according to FIGS. 5 and 6.

A section and a developed view along the line X in FIGS. 5 and 6 is illustrated in FIG. 7. Here, the funnel-shaped expansions 11 of the channels 5*a* and 5*b* join at their respective periphery into each other. This funnel-shaped expansion 11 exhibits an opening angle from about 70 to 110° and preferably an opening angle β1 of 90°.

Figure 8:
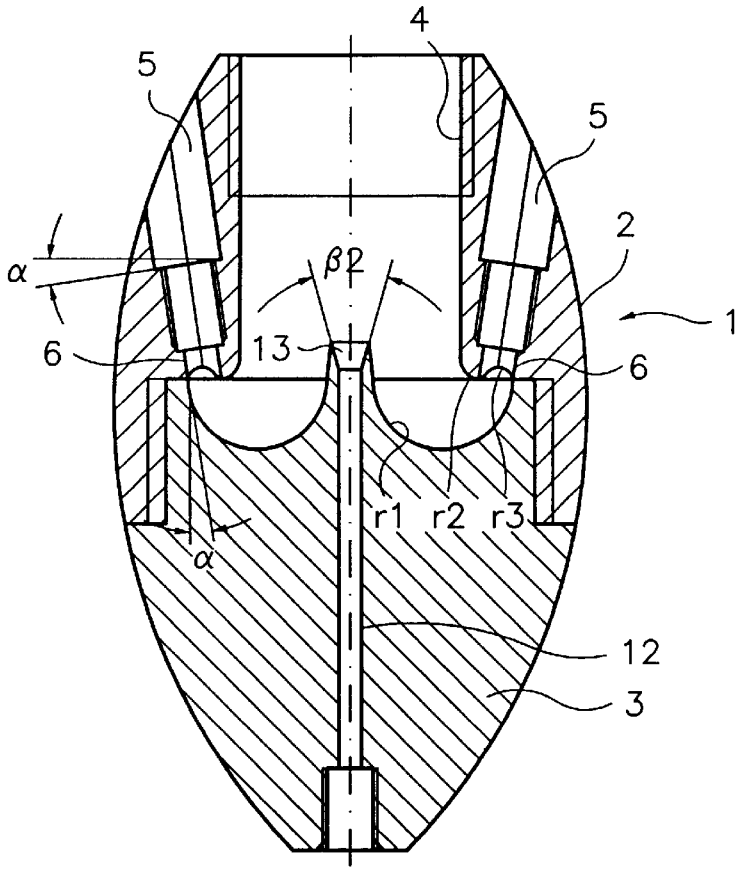
FIG. 8 is a view of a pull nozzle.

In so-called pull nozzles with a centered borehole 12 from the distribution hollow space 7 to the end of the nozzle body 1 opposite to the pressurized water-entrance opening 4 according to FIG. 8, this borehole 12 of a pull nozzle exhibits also a funnel-shaped expansion 13 at its upper end in the direction of the distribution hollow space 7. The opening angle β2 amounts to from about 20 to 40 degrees and is preferably 30°.

There exists also the possibility to produce a nozzle made of one single piece. In order to achieve the same flow-technological advantages, other production procedures are to be employed, such as for example, primitive form or prototype.

In addition to the recited and illustrated examples of a subdivided nozzle, there exists also the possibility to dispose the subdivision plane between the upper part and the lower part of the nozzle body in a different way.

Furthermore, the two nozzle halves can be connected in a disengageable or fixed way to each other in the subdivided construction also based on different known joining methods. The disengageable connection, as already described, is associated with the advantage of an easier and simpler cleaning procedure. At the same time, disengageable, subdivided nozzles can be regenerated in case of possible damages in the nozzle inner space, i.e. the distribution hollow space 7, such that their lifetime can be prolonged by a multiple.

Figure 9:
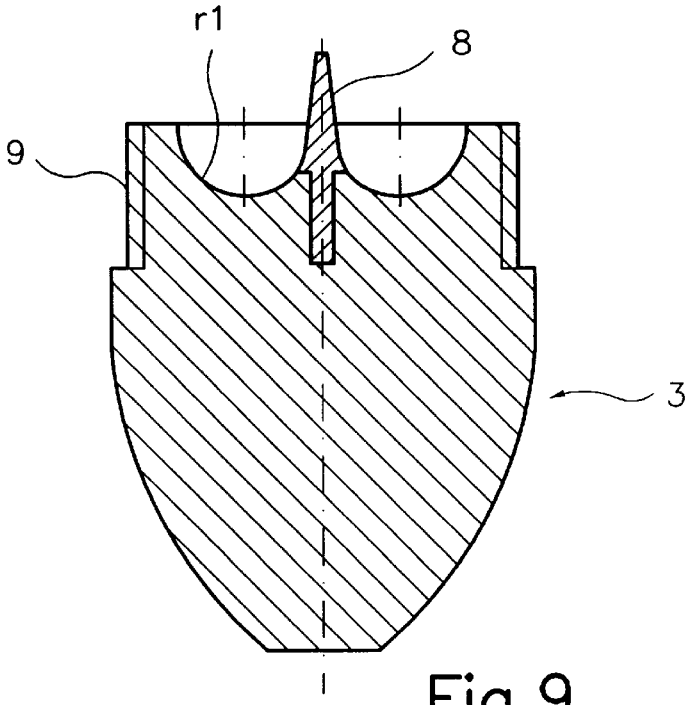
FIG. 9 is a view of a nozzle with an inserted water subdivider.
Figure 10A:
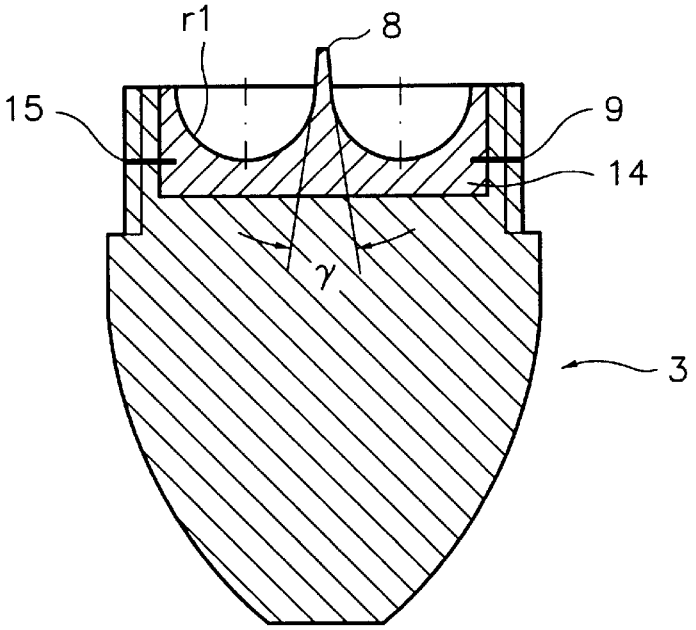
FIG. 10*a* is a sectional view of a nozzle lower part with an inserted form element.
Figure 10B:
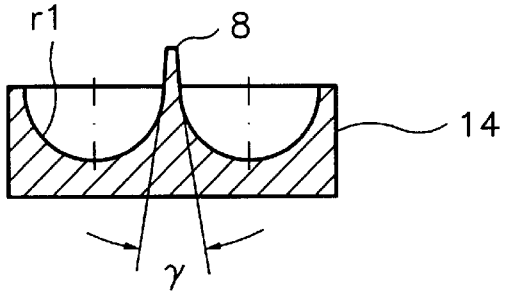
FIG. 10*b* is a sectional view of the form element.
Figure 10C:
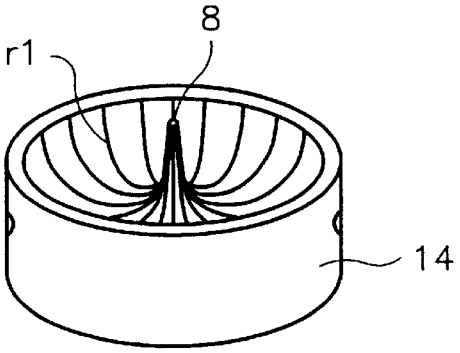
FIG. 10*c* is a perspective view of the form element.

It is further possible in continuation of this concept to produce the conical-shaped water subdivider 8 as a separate part according to FIG. 9 and to place the water subdivider 8 disengageably or fixedly into the nozzle lower part 3. A further advantageous embodiment of the hydrodynamic nozzle comprises that the lower part 3 exhibits a form element 14 according to FIG. 10*a*, which form element 14 forms the water subdivider 8 and the first toroidal segment having a radius r1. The surface of the first toroidal segment is preferably made of a wear-resistant and drag-coefficient-lowering material. The form element 14 is preferably disengageably placed into the lower part such that it can be exchanged in case of wear and, in particular, the form element 14 is arrested with the connection element 15 by screwing or with pins, as illustrated schematically.

Figure 11A:
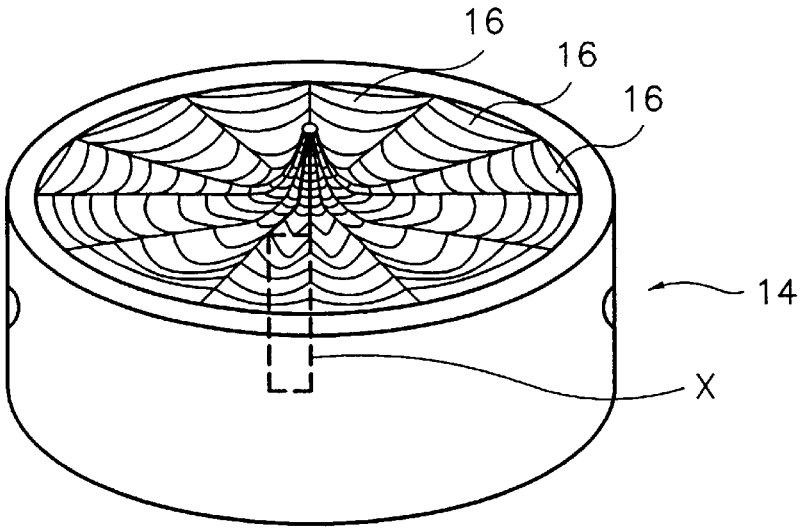
FIG. 11*a* is a perspective view of a form element with a chamber-like subdivision.
Figure 11B:
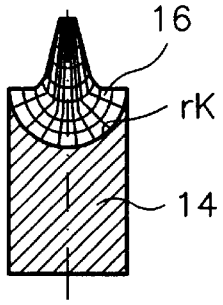
FIG. 11*b* is a sectional and in part perspective view of a first type of chamber segments.
Figure 11C:
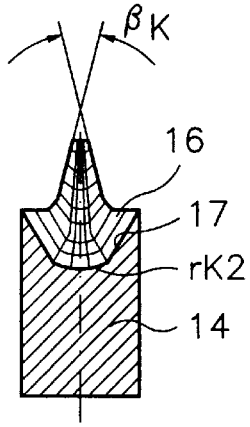
FIG. 11*c* is a sectional and in part perspective view of a second type of chamber segments.

The form element 14 can also be subdivided into several chambers 16 in the form of segments, as illustrated in FIG. 11*a*, wherein the number of the chambers 16 should coincide with the number of the pressurized water-discharge openings. The illustration of two chamber segments with different forms along the line X in FIG. 11*a* is shown in FIGS. 11*b* and 11*c*. According to the construction of FIG. 11*a*, the inner face of the first torus segment is replaced by a plurality of radially expanding troughs corresponding in number to the number of channels 6*a* and 6*b*. The troughs direct more of the flow of the liquid to the channels 8*a*, 6*b* as compared to the inner first torus segment surface. The depths of the troughs can be from about 0.5 to 2 times the protruding height of the water subdivider 8 above the outer edge of the lower part 3. The water subdivider 8 of FIGS. 11*a*, 11*b* and 11*c* exhibits a rotary axis with a symmetry corresponding at least to the number of channels 6*a* or of channels 6*b*.

The chambers 16 are formed as troughs and exhibit also a semi-circular shape with a radius rK as seen in cross-section and as illustrated in FIG. 11*b*. A further variation comprises that the chambers 16 formed as troughs exhibit edges 17 with a defined opening angle βK and a radius rK2 at the base, as shown in FIG. 11*c*, in order to assure an optimum flow-technical behavior of the liquid beam.

The number of the pressurized water-discharge openings 5 (or, respectively, 5*a* and 5*b*) is determined according to the desired planned profile, wherein the beam position angle α of the pressurized water-discharge openings can also be equal for all water-discharge openings such that they are disposed on a common reference circle T. Usually six or more pressurized water-discharge openings are selected.

The beam position angle α can amount to between 5° and 40° and is preferably from about 20 to 30°. Depending on the dimensions of the nozzle (length and diameter), and the required beam position angle α, the radii r1, r2, and r3, the dimensions of the water subdivider 8, as well as the distance L of the center point of the radius r1, are to be determined in a defined way from the start of the nozzle at the side of the hose connection.

Figure 12:
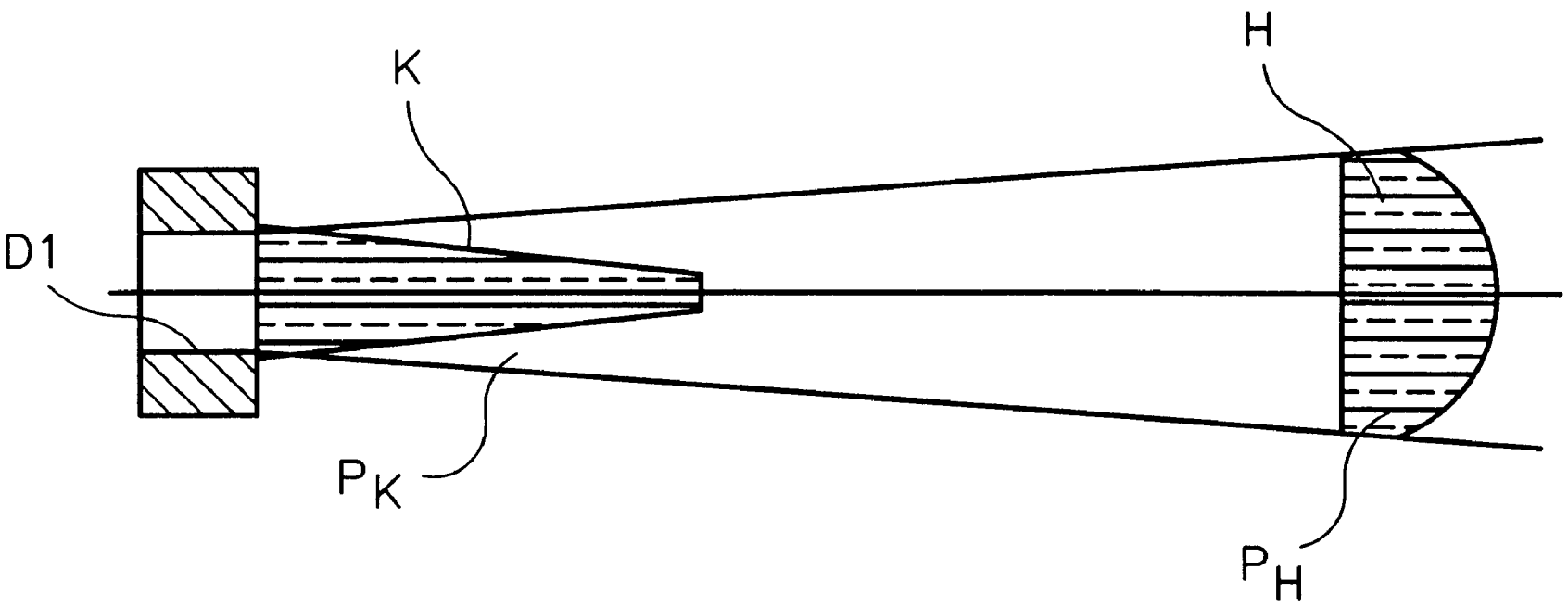
FIG. 12 shows the course of the axial pressure in the beam of liquid.

Based on the flow-technical improvements and the friction decrease based on the coating, the continuous flow region is lengthened or, respectively, the axial pressure PK in the region of the core zone K and the axial pressure PH in the main region H is increased (FIG. 12). The nozzle diameter here is designated as D1.

Based on the increase of the axial pressure, the cleaning effect of the hydrodynamic nozzle according to the present invention is substantially improved relative to that of a conventional nozzle of similar construction.

It will be understood that each of the elements described above, or two or more together, may also find a useful application in other types of nozzles differing from the types described above.

While the invention has been illustrated and described as embodied in the context of a hydrodynamic nozzle for cleaning pipes and channels, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydrodynamic nozzle for a cleaning of pipes and channels and formed as a nozzle base body having an axis and comprising a connector for a water hose constructed as a pressurized water-entrance opening;

a first set of pressurized water-discharge openings disposed on a side of nozzle base body carrying the pressurized water-entrance opening, wherein the pressurized water-discharge openings are aligned on a first part reference circle;

a first set of channels, wherein the pressurized water-discharge openings are connected through the channels of the first set of channels to the pressurized water-entrance opening, and wherein the pressurized water-discharge openings of the first set of pressurized water-discharge openings and the channels of the first set of channels are disposed inclined at a defined angle (α1) relative to the axis of the nozzle base body;

a distribution chamber disposed inside of the nozzle base body and connected to the pressurized water-entrance opening and connected to the channels of the first set of channels for providing a connection between the pressurized water-entrance opening and the pressurized water-discharge openings;

a water subdivider exhibiting a rotary axis and a cone tip and an end disposed opposite to the cone tip and protruding from a base of the distribution chamber, wherein the water subdivider is disposed on an opposite side of the distribution chamber relative to the pressurized water-entrance opening, and wherein the water subdivider is disposed centered relative to the axis of the nozzle base body, wherein the cone tip of the water subdivider is directed in a direction of the pressurized water-entrance opening;

an inner face of substantially a first torus segment having a first radius (r1) of a generating circle of the first torus, said inner face of substantially the first torus merging to an end of the water subdivider, wherein the inner face of the first torus segment is disposed substantially opposite to the pressurized water-entrance opening in the distribution chamber, and wherein the inner face of the first torus segment forms a base of the distribution chamber;

wherein each channel of the first set of channels is inclined at the angle (α1) and merges such into the distribution chamber that an outer line of an outer diameter of a respective channel of the first set of channels merges with the first torus segment.

2. The hydrodynamic nozzle according to claim 1, further comprising a second set of pressurized water-discharge openings disposed on the side of the nozzle base body carrying the pressurized water-entrance opening, wherein the pressurized water-discharge openings of the second set of pressurized water-discharge openings are aligned on a second part reference circle;

a second set of channels, wherein the pressurized water-discharge openings of the second set of pressurized water-discharge openings are connected through the channels of the second set of channels to the pressurized water-entrance opening, and wherein the pressurized water-discharge openings of the second set of pressurized water-discharge openings and the channels of the second set of channels are disposed inclined at a second defined angle (α2) relative to the axis of the nozzle base body;

wherein each channel of the second set of channels is inclined at the angle (α2) and merges such into the distribution chamber that an outer line of an outer diameter of a respective channel of the second set of channels merges with the first torus segment; and wherein the water subdivider exhibits a conical shape and has a defined cone angle (gamma).

3. The hydrodynamic nozzle according to claim 1, further comprising a second torus segment surrounding the pressurized water-entrance opening in the direction of the distribution chamber, and wherein a generating circle of the second torus segment is associated with a second radius (r2), wherein the second radius (r2) exhibits a like direction of curvature as the first radius (r1), and wherein the second torus segment is connected through a further, third torus segment, wherein a generating circle of the third torus segment is associated with a radius (r3), wherein the third torus segment shows an opposite direction of curvature relative to the direction of curvature of a first torus segment.

4. The hydrodynamic nozzle according to claim 1, wherein a diameter of each channel expands in a funnel-shape at an end of the channel, which end joins into the distribution chamber.

5. The hydrodynamic nozzle according to claim 4, wherein an opening angle (β1) of the funnel-shaped expansion amounts to 90°.

6. The hydrodynamic nozzle according to claim 1, wherein the nozzle base body is subdivided into an upper part and a lower part.

7. The hydrodynamic nozzle according to claim 6, wherein a subdivision plane is disposed in a region of the distribution chamber passing through center points of generating circles of the first torus segment and aligned perpendicular to the axis of the nozzle base body, wherein the pressurized water-entrance opening and the pressurized water-discharge openings as well as a face of the second torus segment and a face of the third torus segment are disposed in the upper part, and wherein the water subdivider and the inner face of the first torus segment are disposed in the lower part.

8. The hydrodynamic nozzle according to claim 6, wherein a subdivision plane is disposed in a region of the distribution chamber at a level of the center points of the generating circles of the first torus segment and parallel to the axis (M) of the nozzle base body.

9. The hydrodynamic nozzle according to claim 6, wherein the water subdivider is attached to the lower part of the nozzle base body.

10. The hydrodynamic nozzle according to claim 1, wherein the water subdivider is attached to the nozzle base body.

11. The hydrodynamic nozzle according to claim 1, further comprising a centered axial passage furnished by a through borehole disposed extending from the distribution chamber to an end of the nozzle base body, which end of the nozzle body is disposed opposite to the pressurized water-entrance opening.

12. The hydrodynamic nozzle according to claim 11, wherein the through borehole expands like a funnel at its end in the water subdivider opened in a direction toward the distribution chamber.

13. The hydrodynamic nozzle according to claim 12, wherein an opening angle (β2) of the funnel-shaped expansion of the through borehole amounts to from about 20 to 40°.

14. The hydrodynamic nozzle according to claim 1, wherein faces of the pressurized water-entrance opening, of the distribution chamber, and of channels, along which a flow medium flows, are machined such that a drag coefficient is minimized.

15. The hydrodynamic nozzle according to claim 1, wherein the water subdivider and a base of the distribution chamber, which base is formed by the first torus segment, are furnished with a drag-coefficient-lowering coating (B).

16. The hydrodynamic nozzle according to claim 1, wherein a unit of the water subdivider and of the first torus segment is formed as a separate form element and is disengageably disposed in a corresponding recess in a lower part of the nozzle base body.

17. The hydrodynamic nozzle according to claim 16, wherein the form element is made of a wear-resistant material.

18. A hydrodynamic nozzle for a cleaning of pipes and channels, formed of a nozzle base body having a connector for a water hose as a pressurized water-entrance opening, and having pressurized water-discharge openings on a side of the pressurized water-entrance opening disposed on same a like different part circles, wherein the pressurized water-discharge openings are connected through channels to the pressurized water-entrance openings, wherein the pressurized water-discharge openings and the channels are disposed inclined at a defined angle relative to an axis of the nozzle body, wherein a distribution chamber (7) follows to the pressurized water-entrance opening (4), into which the channels (6*a* and 6*b*), connected to the pressurized water-discharge openings (5*a*, 5*b*), are joining, wherein a conical-shaped water subdivider (8) with a defined cone angle (gamma) is disposed a base of the distribution chamber (7), disposed oppositely to the pressurized water-entrance opening (4), and centered relative to the axis of the nozzle body 1, wherein a cone tip of the conical-shaped water subdivider (8) is directed in a direction of the pressurized water-entrance opening (4), a defined and substantially semi-circular first radius (r1) follows to a cone base of the water subdivider (8), where a curvature of first radius (r1) is directed substantially opposite to the pressurized water-entrance opening (4) and where the first radius (r1) forms the base of the distribution chamber (7), and wherein each channel (6*a*, 6*b*), inclined at an angle ($\alpha$1, $\alpha$2) joins such into the distribution chamber (7) that outermost line of an outer diameter of the channels (6*a*, 6*b*) aligns tangentially at the first radius (r1) or, respectively, merges continuously into the first radius (r1).

19. Hydrodynamic nozzle according to claim 18, wherein the pressurized water-entrance opening (4) exhibits in the direction of the distribution chamber (7) and radially circumferentially a diameter-increasing second radius (r2), wherein the second radius (r2) exhibits a like direction of curvature as the first radius (r1), and wherein the second radius (r2) is connected through a further third radius (r3) with an opposite direction of curvature relative to a direction of curvature of the first radius (r1);

wherein the diameter of each channel (6*a*, 6*b*) is expanded in a funnel-shape at an end of the channel (6*a*, 6*b*), which end joins into the distribution chamber (7);

wherein the nozzle body (1) is subdivided into an upper part (2) and a lower part (3), wherein a subdivision plane is disposed in the region of the distribution chamber (7) in a center point of the first radius (r1) and perpendicular to the axis of the nozzle body (1), wherein the pressurized water-entrance opening (4) and the pressurized water-discharge openings (6*a* and 6*b*) as well as the second radius (r2) and the third radius (r3) are disposed in the upper part (2), and wherein the water subdivider (8) and the first radius (r1) are disposed in the lower part (3), wherein the subdivision plane is disposed in the region of the distribution chamber (7) in the center point of the first radius (r1) and parallel to the axis (M) of the nozzle body (1).

20. The hydrodynamic nozzle according to claim 18, wherein the water subdivider (8) is disengageably or fixedly placed into the nozzle body (1);

wherein the water subdivider (8) is disengageably or fixedly placed into the lower part (3) of the nozzle body (1);

wherein a centered axial through borehole (12) is disposed from the distribution chamber (7) up to the end of the nozzle body (1), which end of the nozzle body (1) is disposed opposite to the pressurized water-entrance opening (4);

wherein the through borehole (12) expands like a funnel at its end in the water subdivider (8) in the direction toward the distribution chamber (7);

wherein an opening angle ($\beta$2) of the funnel-shaped expansion (13) of the through borehole (12) amounts to 30°;

wherein faces of the hollow spaces, at which the flow medium flows along, are machined such that the drag coefficient is minimized;

wherein the water subdivider (8) and the base of the distribution chamber (7), which base is formed by the first radius (r1), are furnished with a drag-coefficient-lowering coating (B);

wherein the water subdivider (8) and first radius (r1) is formed as a separate form element (14) and is disengageably disposed in a corresponding recess in the lower part (3);

and wherein the form element (14) is made of a wear-resistant material.

* * * * *